United States Patent [19]

Kay

[11] 4,352,597

[45] Oct. 5, 1982

[54] SLIDE DOCK

[76] Inventor: Charles Kay, 3401 Burton Ridge Rd., SE., Grand Rapids, Mich. 49506

[21] Appl. No.: 224,216

[22] Filed: Jan. 12, 1981

[51] Int. Cl.[3] ..... E02B 3/20

[52] U.S. Cl. ..... 405/219; 114/263; 182/222; 405/221

[58] Field of Search ..... 405/218, 219, 220, 221; 14/69.5, 73; 114/263; 182/179, 222

[56] References Cited

U.S. PATENT DOCUMENTS

| | | | |
|---|---|---|---|
| 1,646,725 | 10/1927 | Davidson | 182/179 X |
| 2,089,865 | 8/1937 | Voss | 182/222 X |
| 4,041,716 | 8/1977 | Thompson | 405/219 |
| 4,050,257 | 9/1977 | Parks et al. | 405/218 |
| 4,074,537 | 2/1978 | Gronlie | 405/218 |
| 4,123,912 | 11/1978 | Meldrum | 405/220 |
| 4,260,293 | 4/1981 | Peterson | 405/219 |

FOREIGN PATENT DOCUMENTS

| | | | |
|---|---|---|---|
| 763003 | 12/1956 | United Kingdom | 405/219 |

*Primary Examiner*—David H. Corbin

*Attorney, Agent, or Firm*—Price, Heneveld, Huizenga and Cooper

[57] ABSTRACT

A slidably assembled dock is described having spaced facing side channels slidably receiving platform modules, the edges of said modules being within said channels, and the channels being tied together by elongated eye bolt elements which extend through the positioned platform modules. The platform modules have an upper layer notched at the edge to fit smoothly with the channel upper flanges, a lower layer resting on the channels, and connector stringers therebetween.

10 Claims, 15 Drawing Figures

VII
VII
116b
117b
120a
120b
120
120
118
117b
117b
18'
116b
18''
12''
116a
117a
14
10
W
16b
12
18
24
14'
16a
34
24
12'
14''
116b
117b
14'''
14'''

SLIDE DOCK

BACKGROUND OF THE INVENTION

This invention relates to a slidably assembled dock.

In cold northern climates where lakes freeze each winter, removal of docks becomes a necessity to avoid ice damage and/or destruction thereof. A variety of marine dock structures have been proposed and/or employed heretofore, some in attempts to simplify assembly and disassembly thereof for removal in the fall and installation in the spring. One prior structure is set forth in my U.S. Pat. No. 4,212,564. Another prior structure said to be available commercially is assembled with boards held in channels. Other structures are described in U.S. Pat. Nos. 2,652,694, 2,571,337, 3,287,919, 2,948,121, 3,824,796 and 3,073,274.

SUMMARY OF THE INVENTION

The novel dock of this invention has modular platforms slidably assembled into pairs of channels. The channels are retained within a predetermined maximum spacing from each other by transverse tie rods extending therebetween, such tie rods also extending through and securing the modular platforms against sliding action after assembly. The planks of the upper layer of the platforms are notched to interfit smoothly with the upper flanges of the channels. The platforms have spaced and interconnected upper and lower layers.

DESCRIPTION OF THE PREFERRED EMBODIMENT

Figures 1, 6, 7:
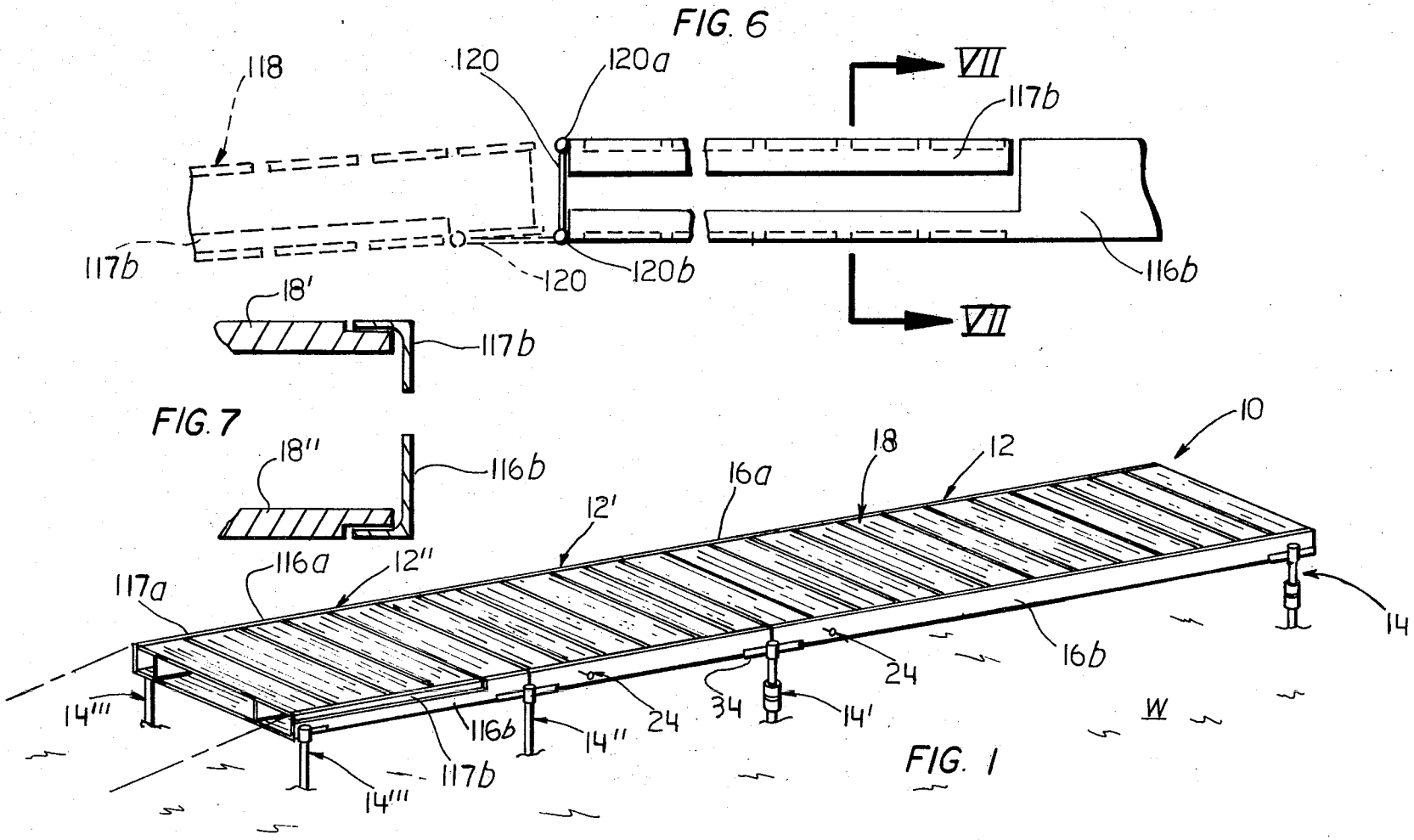
FIG. 1 is a perspective view of one form of the slidably assembled dock.
FIG. 6 is an enlarged side elevational fragmentary view of the portion of the dock on the left end in FIG. 1.
FIG. 7 is a fragmentary sectional view taken on plane VII—VII of FIG. 6.
Figure 15:
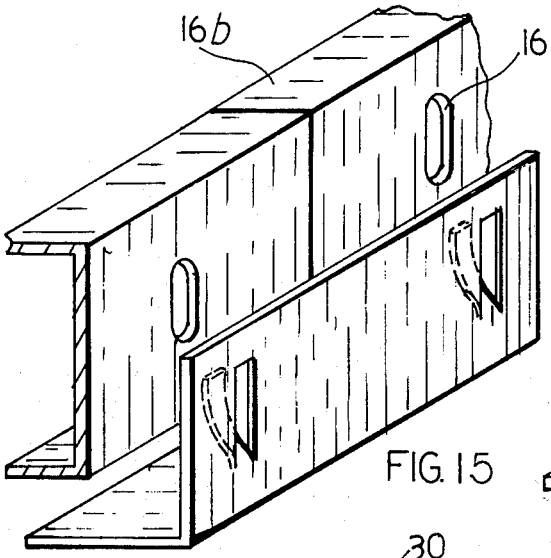
FIG. 15 is a fragmentary perspective view depicting the interconnection of a leg support with adjacent ends of two end-to-end channels hereof.
Figure 13:
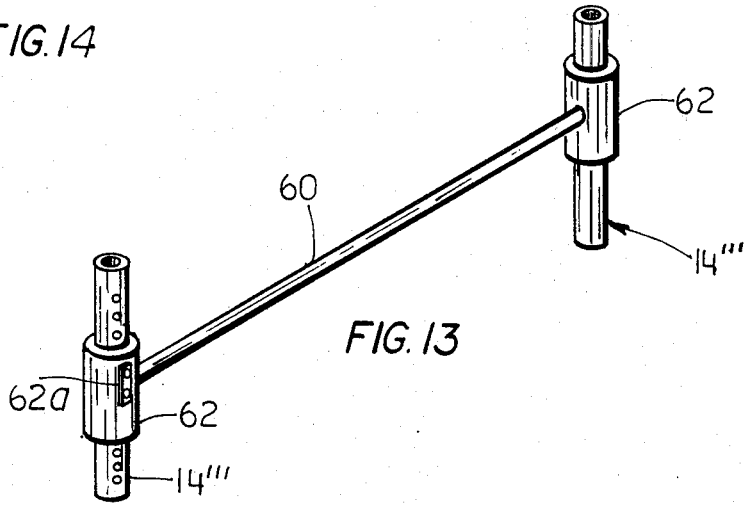
FIG. 13 is a fragmentary perspective view of a cross coupler for the legs.

Referring now specifically to the drawings, the slidably assembled dock 10 is there illustratively depicted to include three representative subassemblies 12, 12' and 12''. The dock is shown supported above water W on vertical leg supports. The outer end pair of leg supports 14 have components depicted more specifically in FIGS. 8, 9 and 10, to be described more fully hereinafter. The next inboard pair of leg supports 14' serve to support the adjacent ends of subassemblies 12 and 12', and have components shown more specifically in FIGS. 9, 10 and 15, to be described more fully hereinafter. The next inboard pair of leg supports 14'' support the adjacent ends of subassemblies 12' and 12''. The innermost pair of leg supports 14''' as depicted in FIG. 1 support the inner end of the modified subassembly 12'', this modified subassembly being explained more fully relative to enlarged FIGS. 6 and 7 hereinafter. Each pair of leg supports, i.e. 14, 14', 14'' and 14''' may be cross braced with the tie coupler illustrated in FIG. 13.

It is important to this invention that the entire dock assembly, of a chosen length and number of subassemblies, be capable of rapid sliding assembly and disassembly for ease of mounting and dismounting of the arrangement in the spring and fall of the year. The slidably assembled dock is formed of components which are readily handled by the home or cottage owner, e.g. a husband and wife team. It is assembled basically without bolts. The construction herein is uniquely designed to these ends, with certain optional features being depicted to allow effective anchoring of the structure, adaptation to a shore level at a different elevation than the dock itself, and, if desired, a floating arrangement.

The individual subassemblies, e.g. 12 and 12', can be of selected modular lengths such as 12 ft. and 6 ft. or 8 ft. and 4 ft., respectively. For convenience, these modular units will be described in lengths of 8 ft. and 4 ft. hereinafter, without intending to be limited thereto.

Figure 14:
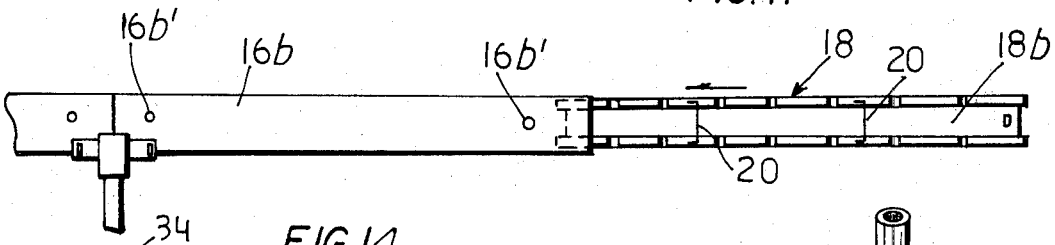
FIG. 14 is a side elevational view showing the sliding assembly of components of this invention.
Figure 12:
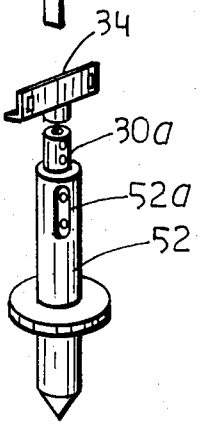
FIG. 12 is a perspective view of an alternative telescopically adjustable leg subassembly.

The individual subassembly, e.g. 12, includes a pair of elongated C-shaped channels **16*a* and 16*b* in opposite, spaced, facing relationship to each other, within and between which is a slidably inserted platform module 18 insertable lengthwise into the channel retainers in the manner depicted in FIG. 14**.

The channel members may be formed of a metal such as steel with a protective surface coating, or such as stainless steel, or even aluminum preferably anodized to a desired color. Alternatively, they may be formed of a polymeric material such as polypropylene or nylon of a selected color. The platform module 18 inserted into the 8 ft. long channels **16*a* and 16*b*** can either be of the full length of the channels or, if desired, of two 4 ft. lengths sequentially slid into position.

The platform modules can be of varied construction. Each of the platform modules is shown composed of an upper layer formed of a series of adjacent transverse planks 18', a lower spaced layer preferably also composed of planks 18'' or the equivalent, and two, three, or more elongated stringer plates or splines (here shown to be two in number) **18*a* and 18*b* normal to the planks and extending longitudinally relative to the elongated dock. The planks are normally of wood, but can be of a suitable equivalent, e.g. a polymer. If of wood, the planks can be coated or stained to a desired color, and treated for weather and insects. If of a polymer, the planks are of a selected color. The splines are preferably of metal, each having a pair of upper and lower edge flanges embedded into the upper and lower layers as by the equipment and techniques in U.S. Pat. Nos. 3,714,696 or 3,751,794. Transverse short reinforcing splines 20** (FIG.

14) can optionally be inserted into the two layers as previously taught in U.S. Pat. No. 4,212,564.

Figure 4:
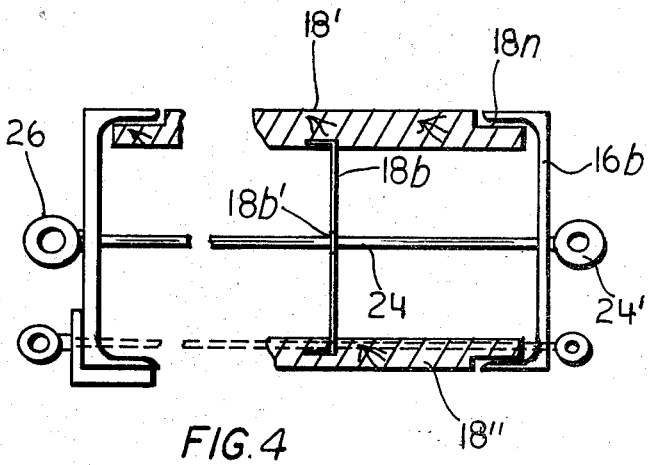
FIG. 4 is a fragmentary, enlarged, end elevational view of the dock in FIG. 1, viewed from the right end.
Figure 5:
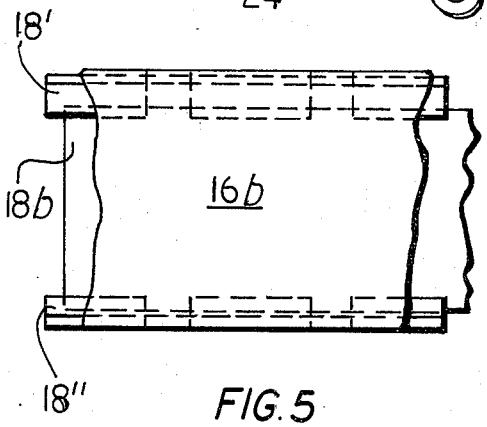
FIG. 5 is a side elevational fragmentary view of the structure in FIG. 4.

The ends of the individual planks of the upper layer are notched at 18*n* (FIG. 4) to receive the upper flanges of the C-shaped channels 16*a* and 16*b* so that the upper surfaces of the channels do not protrude above the upper surface of the upper layer to present a safety problem. Preferably the two are basically coplanar. Optionally, the lower portions of the lower layer elements can also be notched as depicted in FIG. 4 so that the upper and lower portions of the platform modules can be interchangeable.

The upper surface of the platform is preferably coated with a friction material such as sand embedded in a weatherproof resin, for optimum footage. This same surfacing material can be applied to the undersurface of the platform to make the platform surfaces interchangeable.

Figure 2:
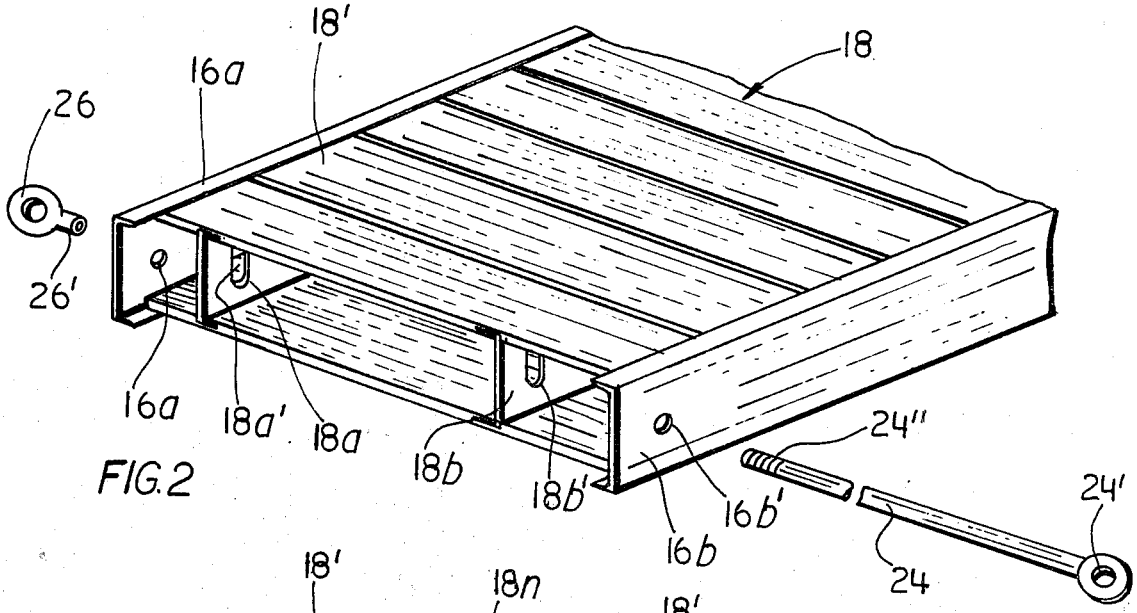
FIG. 2 is an enlarged fragmentary perspective view of one portion of the dock in FIG. 1.

After the individual platform modules are longitudinally slid into place within the channels, elongated tie elements, preferably in the form of long eye bolts (FIG. 2) 24 are extended transversely across the dock through aligned openings in the channels and through the platform modules. As depicted in FIG. 2, the eye bolts extend through openings 16*a*′ and 16*b*′ in channels 16*a* and 16*b* respectively, and through aligned openings 18*a*′ and 18*b*′ in the splines 18*a* and 18*b*, respectively. The elongated eye bolt 24 has an enlarged ring or eye 24′ on one end and is threaded at 24″ on the other end. Ring or eye member 26 is connected to this threaded portion 24″ with a threaded socket 26′. The tie rods retain the channel members within a predetermined maximum spacing relative to each other, to keep them in overlapping relationship with the platform modules, and also to retain the platform modules from sliding movement within the channels once the unit is assembled. Ring element 26 can alternatively be connected to tie rod 24 with a conventional cotter key through transverse openings in these two members in overlapping relationship, rather than with threads. The tie rods may alternatively be positioned as depicted in FIG. 4 in phantom lines, at the lower part of the channels so as to extend between the individual planks of lower layer 18″.

The rings or eyes on the ends of the tie elements serve as hand-hold members, serve to retain the assembly laterally, and can be used to tie boats to the dock.

Figure 8:
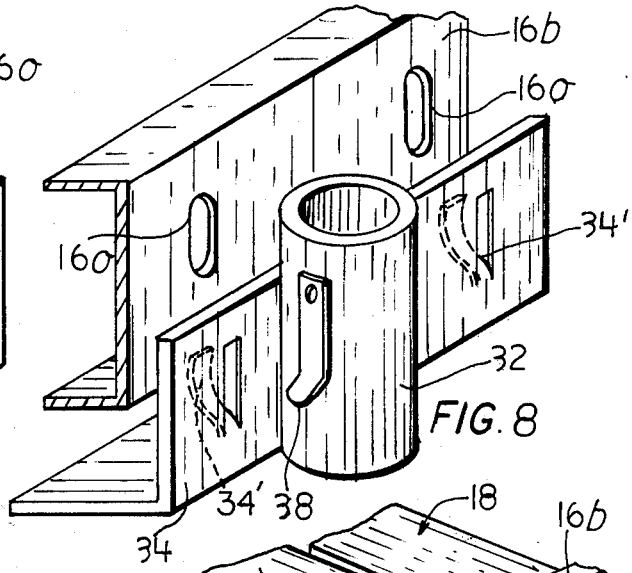
FIG. 8 is a fragmentary perspective view of a portion of the support subassembly.
Figure 9:
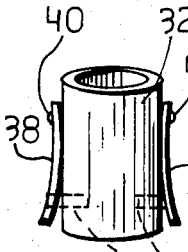
FIG. 9 is an elevational perspective view of a component in FIG. 8.
Figure 10:
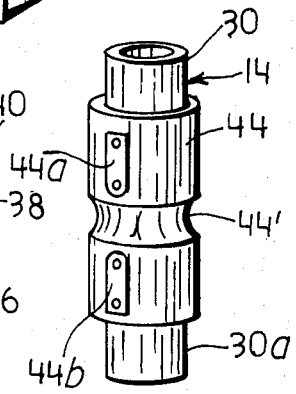
FIG. 10 is a perspective view of a leg segment coupler for the dock.

The vertical supports 14 etc. are connected to the apparatus using the components depicted in FIGS. 8, 9 and 10. Specifically, the leg support 14 comprises an elongated leg 30 typically of cylindrical configuration with a cross section of circular or polygonal shape, slidably received in a vertical collar 32 weldably secured to the vertical flange of an angle iron bracket 34. The leg preferably has a series of vertically spaced openings therein to cooperate with a pair of pins 36 (FIG. 9) protruding inwardly from opposite sides of collar 32 and mounted on a pair of spring metal elements 38 secured by rivets 40 to collar 32. Thereby, the position of the post relative to the collar can be vertically adjusted. Each angle iron bracket 34 has its horizontal flange underlying a channel member, e.g. 16*b* for support thereof. The bracket and channel are interconnected with tangs 34′ integral with, partially severed from, and laterally offset from the bracket as by stamping techniques, to protrude laterally inwardly and upwardly for insertion into cooperative openings 16*o* in a channel.

The individual leg support subassembly 14 can optionally be composed of a plurality of pipe elements connected end to end in a coupler 44 (FIG. 10). Coupler 44 has a central indent 44′ to limit the axial extension of pipe elements 30 and 30*a* therein, and employs spring clips 44*a* and 44*b* of the type previously described relative to elements 38 in collar 32 (FIG. 9) for attachment to the orificed ends of the posts.

At the juncture between two dock subassemblies, e.g. between subassemblies 12 and 12′, a similar support arrangement shown as at 14′ can be employed. Specifically, referring to FIG. 15, the channel members shown in end to end abutting relationship each have respective openings 16*o* to receive the offset tangs of the overlapping angle iron bracket 34, (collar 32 is shown removed from the bracket in FIG. 15 to allow the juncture between the channel members to more readily be observed).

Figure 3:
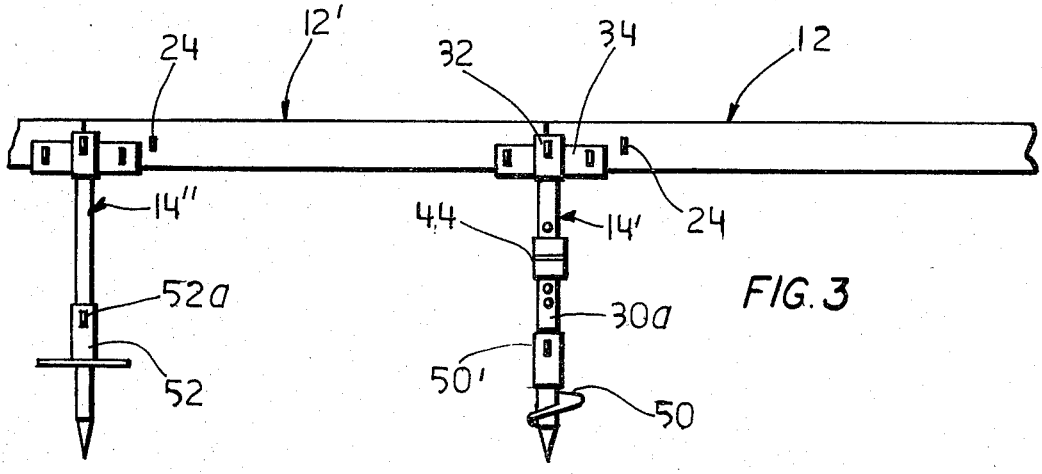
FIG. 3 is a side elevational view of a portion of the dock in FIG. 1.

The bottom end portion of each of the vertical supports can include an optional mud plate or auger if desired for known purposes. More specifically, referring to FIG. 3, the vertical support 14′ is shown to include an auger 50 at the bottom thereof. The auger includes a collar that fits over the lower end of post element 30*a*, attached as by a spring clip element 50′ comparable to element 38 described with respect to FIG. 9. This enables the post to be augered into the ground beneath the water. Alternatively, the base of the post can include a mud plate attachment 52 (FIG. 3) having a collar which fits over the bottom of the post of supports 14″, and including a spring clip 52*a* comparable to element 38 described with respect to FIG. 9.

The individual pairs of posts of the vertical supports, e.g. vertical supports 14‴, are preferably interconnected by a transverse cross bar coupling including a rod or bar 60 (FIG. 13) having at its opposite ends a pair of sleeves 62 for slidably receiving the posts and including a pair of spring clips 62*a* of the type described at 38 relative to FIG. 9 for attachment.

In the embodiment depicted in FIGS. 1, 6 and 7, subassembly 12″ is specially formed to adapt to a shoreline which may be above or below the level of the dock. This optional arrangement includes a pair of modified channel elements 116*a* and 116*b* which have the upper inner end portions cut away to form a pair of shiftable angle iron supports 117*a* and 117*b*. The ends of these are connected to the lower portion of the channels by a double pivot hinge 120. It has a pivotal connection 120*a* to members 117*a* and 117*b*, and a pivotal connection 120*b* to the lower portion of channel elements 116*a* and 116*b*. This enables members 117*a* and 117*b* to be pivotally shifted from the solid line position lines in FIG. 6. This allows the ends thereof to rest on a shoreline such that a platform module 118 can be supported thereon. To disassemble this portion of the apparatus therefore simply requires removal of the platform module 118, and pivotally shifting the elements 117*a* and 117*b* from the extended condition to the folded condition depicted in FIG. 6.

Figure 11:
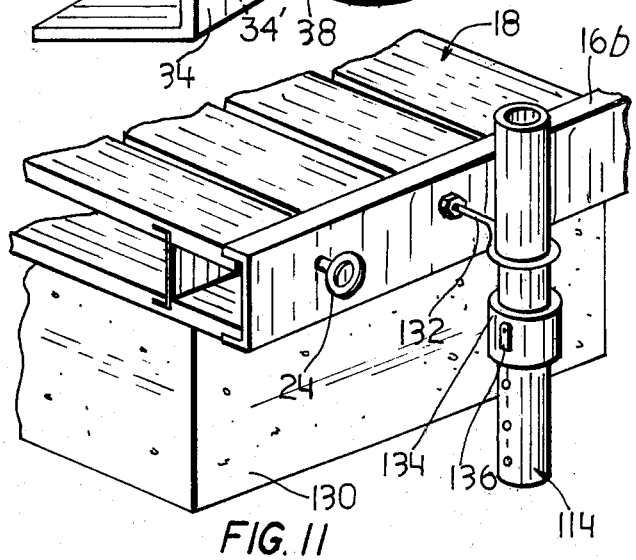
FIG. 11 is a fragmentary perspective view of an alternative support mechanism for the dock.

Optionally, a floatation type support arrangement may be employed, such being depicted in exemplary form in FIG. 11. That is, the platform module 18 in channels 16*a* and 16*b* of the type previously described and held together by tie bolts 24, is supported upon one or more conventional buoyant bodies 130, e.g. of a rigid polymeric foam material. The assembly is retained within pairs of vertical posts 114, the lower ends of which are embedded in or supported on the ground.

Lateral positioning is maintained between the components by slide ring elements 132 projecting from the outside faces of the channels and encircling the posts, to be vertically slidable thereon. The lower limit of the slide ring is determined by a fixed collar 134 around the post, secured as by spring clips 136 of the type described at 38 in FIG. 9.

As will be readily understood from the above description, assembly and disassembly of this dock apparatus is relatively easy. The individual channels are attached to the angle iron brackets which in turn are anchored on the vertical supports. The platform modules are slid in place longitudinally within the channels, and anchored in position by the elongated transverse tie rods which keep the channels in their proper spaced relationship.

Although the preferred embodiment and certain variations thereon have been depicted and described herein, it is conceivable that additional variations may be made within the concept presented. Hence, the invention is intended to be limited only by the scope of the appended claims and the reasonable equivalents thereto rather than to the specific embodiments described as illustrative.

The embodiments of the invention in which an exclusive property or privilege is claimed are defined as follows:

1. A slidably assembled dock comprising:

at least one pair of spaced, facing side channels, each including an inwardly directed upper flange and an inwardly directed lower flange;

modular platforms extending between said side channels and having edge portions slidably received in said side channels;

said modular platforms being formed of an upper layer and a lower layer spaced therefrom, and elongated stringers interconnecting said layers;

said lower layer supported on said lower flanges of said side channels and said upper layer interfitting with said upper flanges;

tying connector means for maintaining said side channels within a predetermined maximum spacing of each other;

and support means for vertically supporting said dock.

2. The dock in claim 1 wherein:

said tying connector means comprises elongated tying elements between said side channels and through said modular platforms, thereby securing said platforms in position.

3. The dock in claim 2 wherein said tying elements comprise transverse tie rods having eyes on the ends thereof.

4. The dock in claim 2 wherein:

said modular platform stringers are metal plates extending lengthwise of said dock with edge portions embedded in said upper and lower layers, and have openings through which said tying elements extend.

5. The dock in claim 1 wherein:

said upper layer has notched edge portions interfitted with said channel upper flanges whereby said upper flanges do not project above said upper layer.

6. The dock in claim 1 wherein said support means comprise vertical posts attached to support brackets in supporting relationship with said side channels.

7. The dock in claim 6 wherein said brackets have tangs and channels have openings receiving said tangs for connection of said brackets to said channels.

8. The dock in claim 6 wherein said brackets include collars slidably receiving said posts, and spring clip connectors therebetween.

9. The dock in claim 1 wherein said support means comprises:

floatation units for buoyantly supporting said dock, and interconnecting vertical slide means allowing vertical movement with lateral restraint of said dock.

10. The dock in claim 9 wherein said vertical slide means includes slide elements on said channels slidably interfitted with fixed vertical posts.

* * * * *